US006940389B1

(12) United States Patent
Yu

(10) Patent No.: US 6,940,389 B1
(45) Date of Patent: Sep. 6, 2005

(54) MECHANISM FOR ENSURING BIMETALLIC PLATE TO BE DEFORMED WITHOUT BARRIER

(76) Inventor: Tsung-Mou Yu, No. 4, Alley 2, Lane 23, Sec. 3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 10/845,720

(22) Filed: May 14, 2004

(51) Int. Cl.[7] ..... H01H 71/16
(52) U.S. Cl. ..... 337/66; 337/59
(58) Field of Search ..... 337/66, 59; 200/553; 29/622

(56) References Cited

U.S. PATENT DOCUMENTS

| | | | | |
|---|---|---|---|---|
| 4,167,720 | A | 9/1979 | Krasser | 337/60 |
| 4,937,548 | A | 6/1990 | Sdunek | 337/70 |
| 5,223,813 | A | 6/1993 | Cambreleng et al. | 337/66 |
| 5,262,748 | A | 11/1993 | Tsung-Mou | 337/66 |
| 5,451,729 | A | 9/1995 | Onderka et al. | 200/18 |
| 5,539,371 | A * | 7/1996 | Yu | 337/66 |
| 5,558,211 | A | 9/1996 | Heydner et al. | 200/553 |
| 6,400,250 | B1 * | 6/2002 | Wang | 337/66 |
| 6,483,416 | B2 * | 11/2002 | Yu | 337/126 |

* cited by examiner

*Primary Examiner*—Lynn Feild
*Assistant Examiner*—Corey Broussard

(57) ABSTRACT

A circuit breaker includes a bimetallic plate that has a first end fixed to one terminal and a second end which can be lowered to contact the other terminal by pushing the push-button on top of the case of the breaker. The second end of the bimetallic plate is movably supported in a slot of a support member that is connected to an end of the pushbutton and is movable along an inclined surface of a protrusion in the case. The slot has a shorter upper edge so that when the support plate is shifted to a side when the pushbutton is set to its close-circuit position, the second end of the bimetallic plate can be deformed upward without any barrier by the upper edge of the slot.

8 Claims, 11 Drawing Sheets

(OFF)

(OFF)

(ON)

(OFF)

(OFF)

(ON)

(ON)

MECHANISM FOR ENSURING BIMETALLIC PLATE TO BE DEFORMED WITHOUT BARRIER

FIELD OF THE INVENTION

The present invention relates to a circuit breaker that includes a movable support member that freely supports an end of a bimetallic plate, which is ensured to be bent without barrier when overloading occurs.

BACKGROUND OF THE INVENTION

A conventional circuit breaker uses a fuse between a switch and a circuit so that when electrical overloading occurs, the fuse melts off first before the overloading causes damage to the circuit. However, if the fuse is not properly installed or an improper fuse is used, the overloading current does not melt the fuse and a disaster can occur. U.S. Pat. Nos. 5,262,748, 4,167,720, 4,937,548, 5,223,813, 5,451,729, and 5,558,211 disclose different types of circuit breakers which commonly include a complicated mechanism to drive the bimetallic plate that is expected to be deformed and bent when overloading occurs. Nevertheless, it is noted that in some cases, even when an overloading occurs, the bimetallic plate does not completely deform as desired and remains in contact with a terminal of the circuit so that sparks could be produced, causing disaster.

Therefore, it is desired to have a mechanism that ensures the bimetallic plate to be deformed as desired and designed so that the circuit is completely cut off.

SUMMARY OF THE INVENTION

In accordance with an aspect of the present invention, there is provided a circuit breaker that comprises a case having a pushbutton pivotally connected between a front wall and a rear wall of the case. First and second terminals respectively extend through a bottom of the case. A first end of a bimetallic plate is fixedly connected to the first terminal and a first contact point is connected to a second end of the bimetallic plate. A second contact point is connected to the second terminal and located beneath the first contact point. A support member has an insertion bar at one end thereof and a slot in a side of the other end. The insertion bar is movably connected to the pushbutton and a second end of the bimetallic plate is removably supported by the slot. A protrusion is located in the case and the support member is movable on an inclined surface on the protrusion.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENTS

Figure 1:
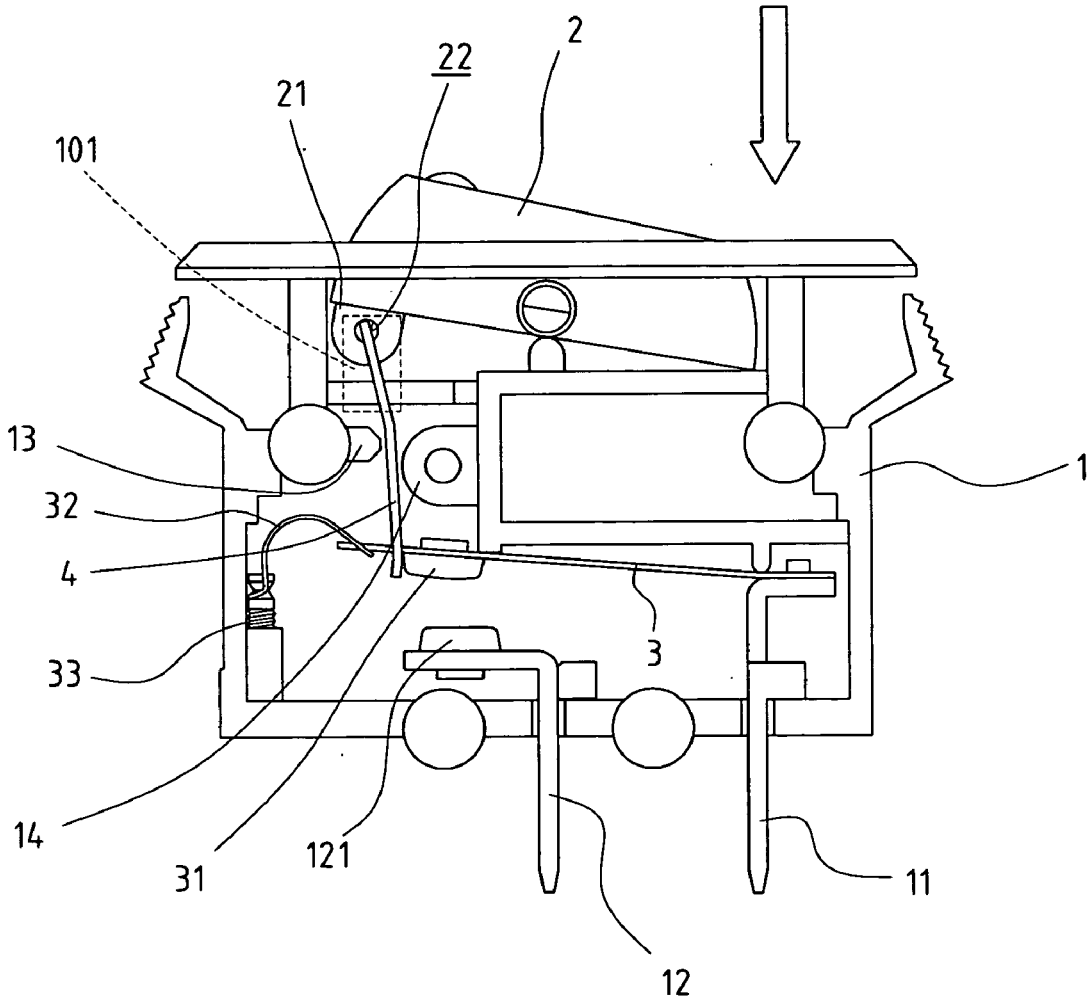
FIG. 1 shows a circuit breaker of the present invention in an "OFF" position.

Referring to the drawings and in particular FIGS. 1, 2, 4, and 5, a circuit breaker in accordance with the present invention comprises a case 1 having an open top. A pushbutton 2 is pivotally connected between a front wall 10 and a rear wall of the case 1. The pushbutton 2 includes an extension 21 projecting from an underside thereof at an "ON" end of the pushbutton 2. The extension 21 has a hole 22 defined therethrough. A first terminal 11 and a second terminal 12 each have an end located in the case 1 and the other ends respectively extend through a bottom of the case 1. A first end of a bimetallic plate 3 is fixedly connected to the first terminal 11. A first contact point 31 is connected to an underside of a second end of the bimetallic plate 3. A second contact point 121 is connected to the second terminal 12 and located beneath the first contact point 31. As can be seen from FIG. 5, the bimetallic plate 3 is a long strip member which may be deformed when the circuit breaker is overloaded with a large current.

Figure 4:
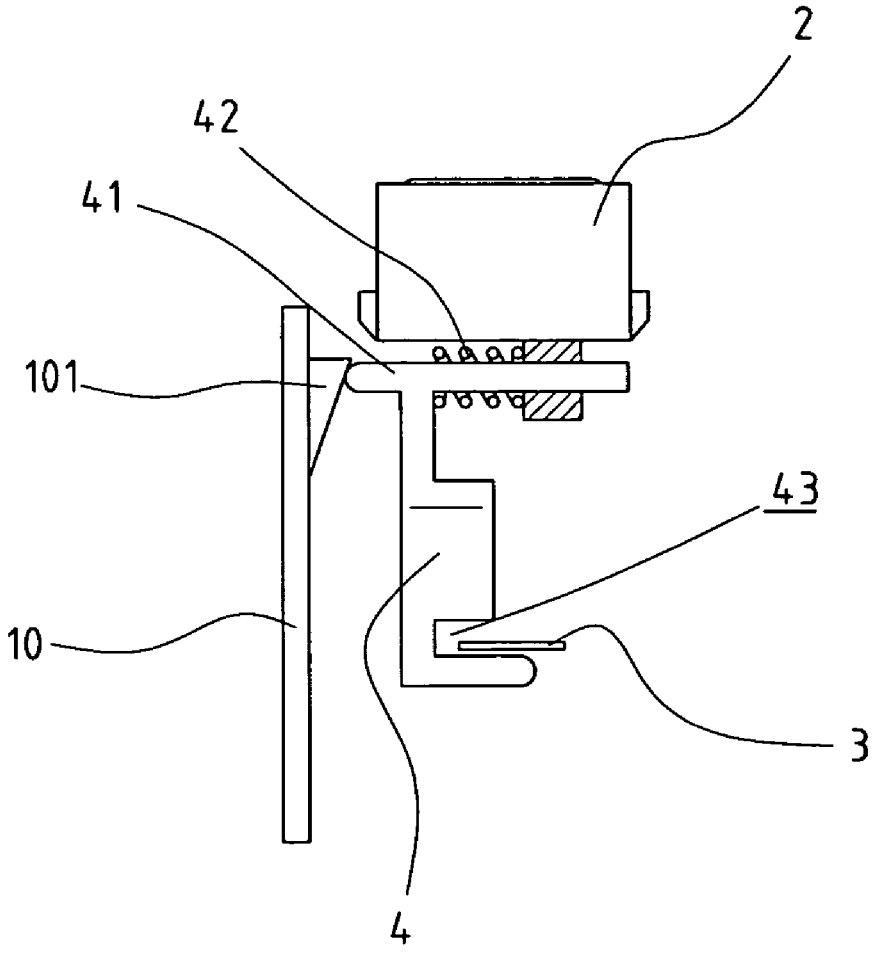
FIG. 4 shows that an end of the bimetallic plate is supported by a slit of a support member.
Figure 5:
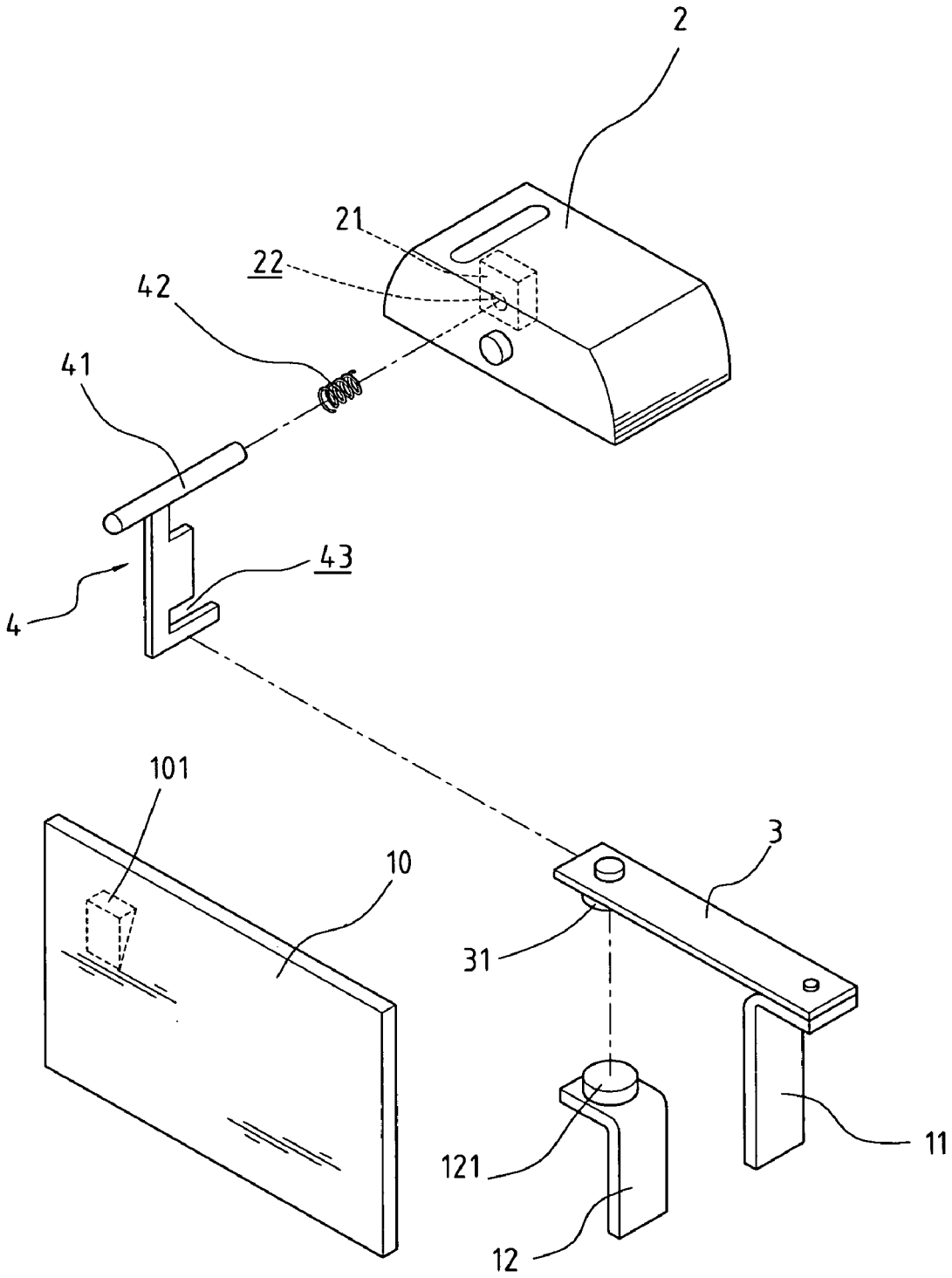
FIG. 5 is an exploded view showing the support member, the bimetallic plate, a pushbutton, and a protrusion on a front wall of a case.

A support member 4 has an insertion bar 41 at one end thereof and a slot 43 is defined in one side of the other end. Two blocks 13, 14 are located in the case 1 and the support member 4 is movably located between and guided by the two blocks 13, 14. A spring 42 is mounted to a first end of the insertion bar 41 and the first end of the insertion bar 41 is movably inserted through the spring 42 into the hole 22 of the extension 21 on the pushbutton 2. The spring 42 is biased between the extension 21 and the support member 4. A protrusion 101 extends from an inside of the front wall 10 and includes an inclined surface. A second end of the insertion bar 41 of the support member 4 is movably in contact with the inclined surface of the protrusion 101. As can be seen in FIG. 4, the spring 42 pushes the support member 4 towards the front wall 10 so that the second end of the insertion bar 41 is pushed against the inclined surface of the protrusion 101. A second end of the bimetallic plate 3 passes through the slot 43 and is removably supported by the slot 43. The slot 43 is defined by an upper edge and a lower edge that is longer than the upper edge so that when the support member moves away from the pushbutton 2 along the inclined surface of the protrusion 101, the upper edge is moved left in a side way perpendicular to the longitudinal direction of the bimetallic plate 3 and the second end of the bimetallic plate 3 can bend upward freely.

Figure 2:
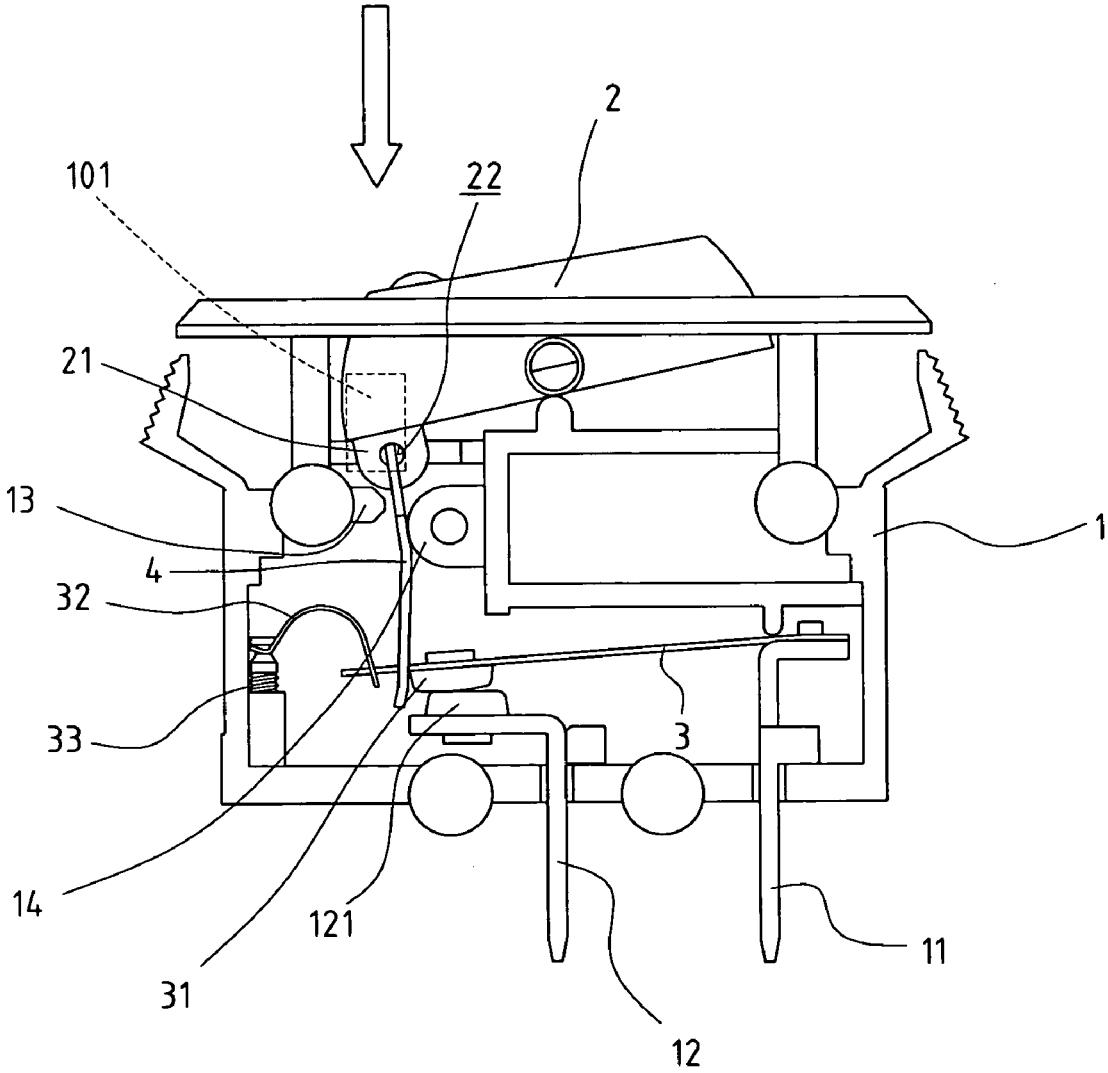
FIG. 2 shows the circuit breaker in an "ON" position.
Figure 3:
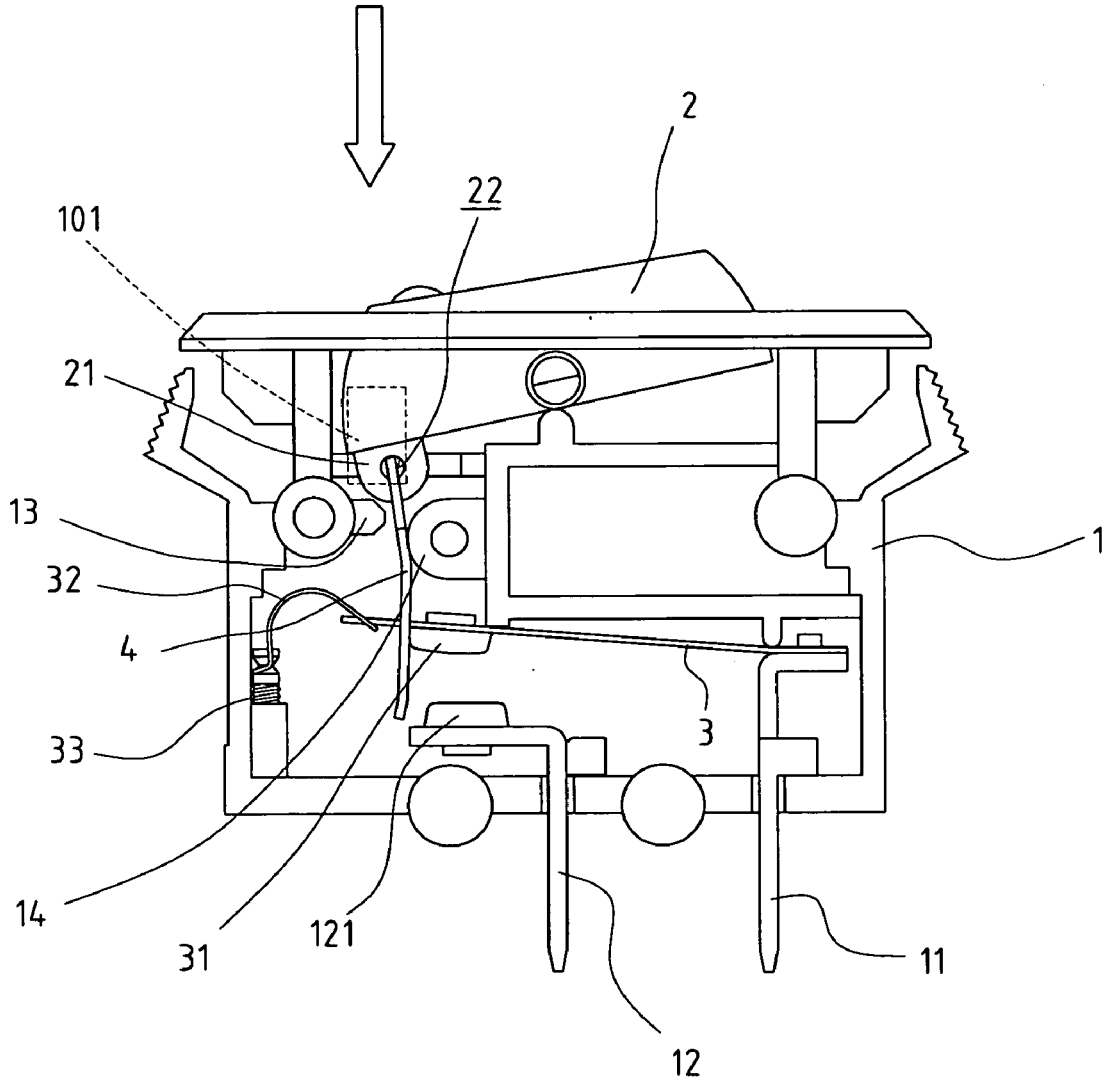
FIG. 3 shows that a bimetallic plate is deformed to cut off the circuit when overloading happens.
Figure 6:
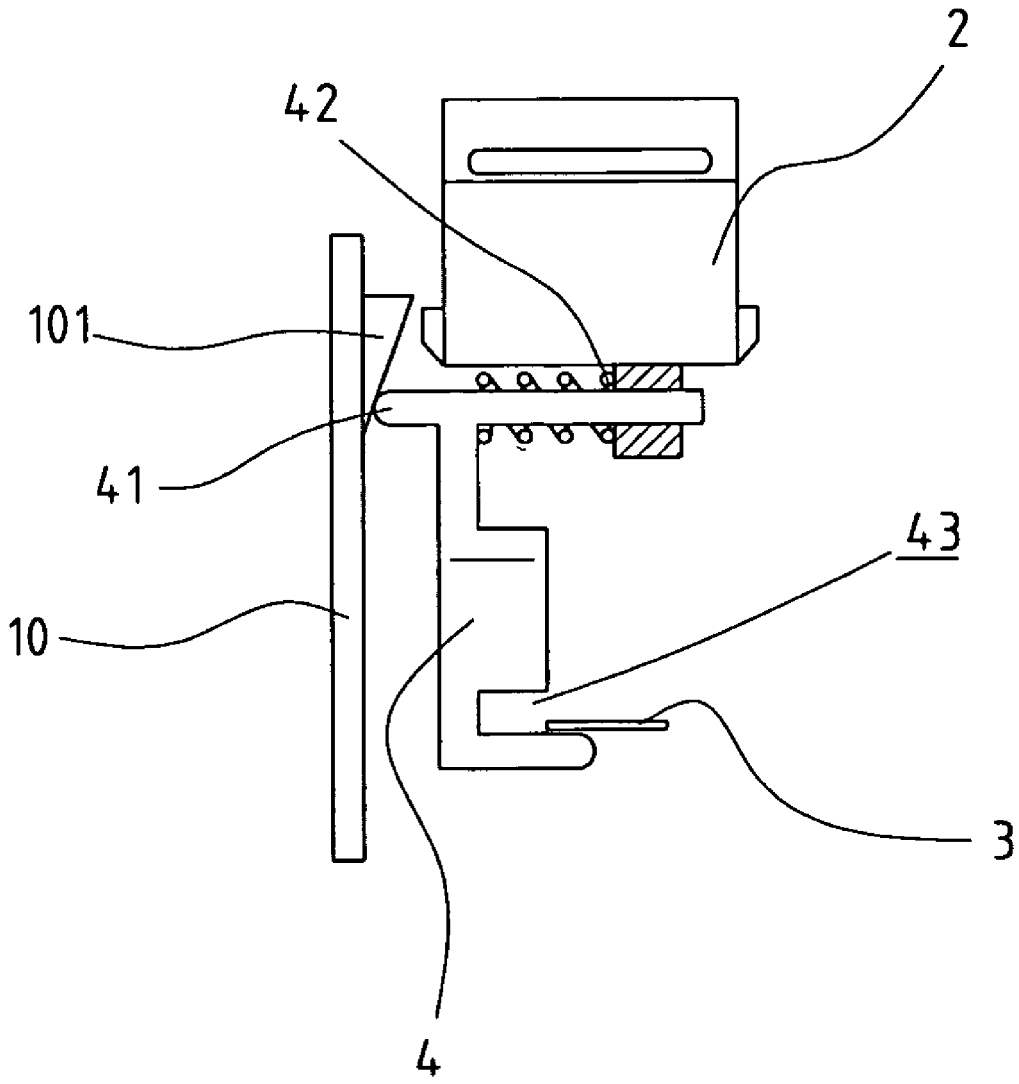
FIG. 6 shows that the support member is shifted away from the bimetallic plate.
Figure 7:
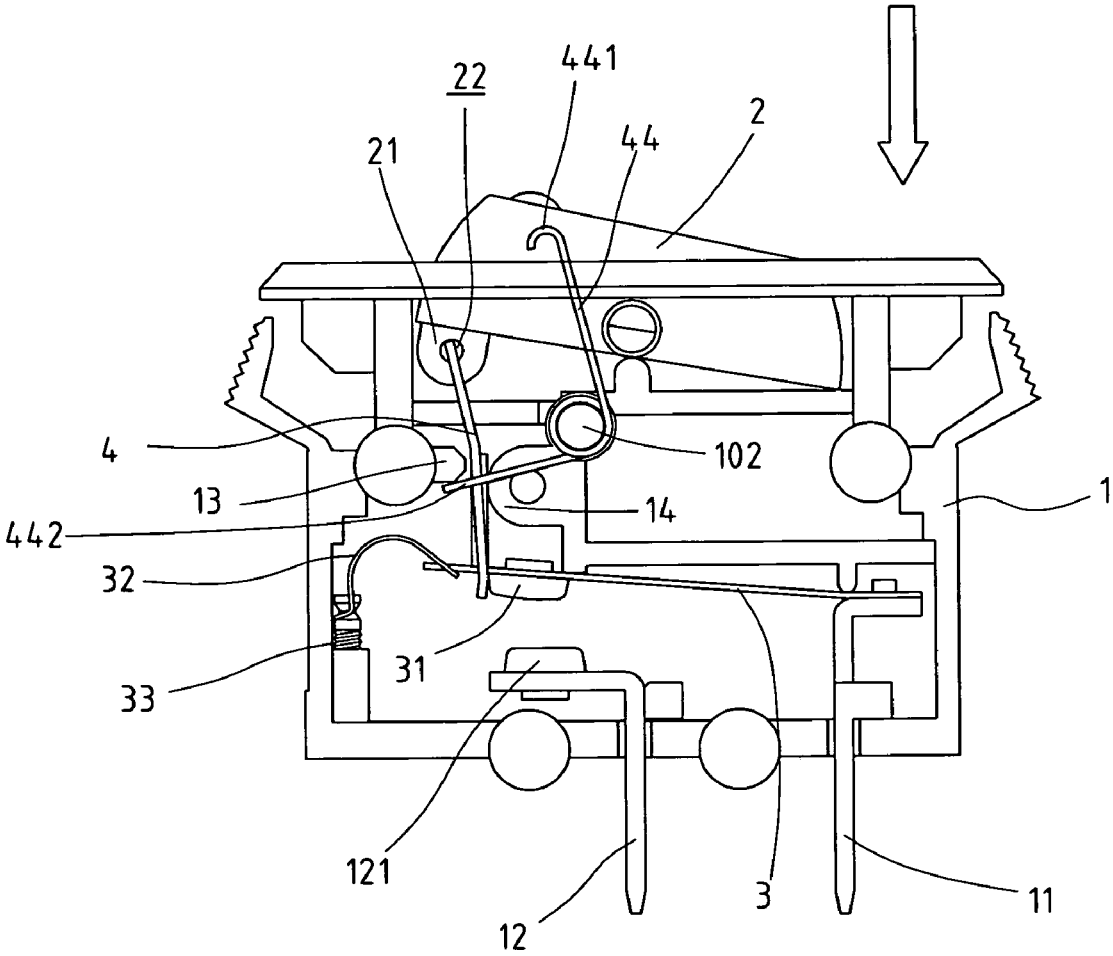
FIG. 7 shows that another embodiment of the circuit breaker of the present invention in an "OFF" position.
Figure 8:
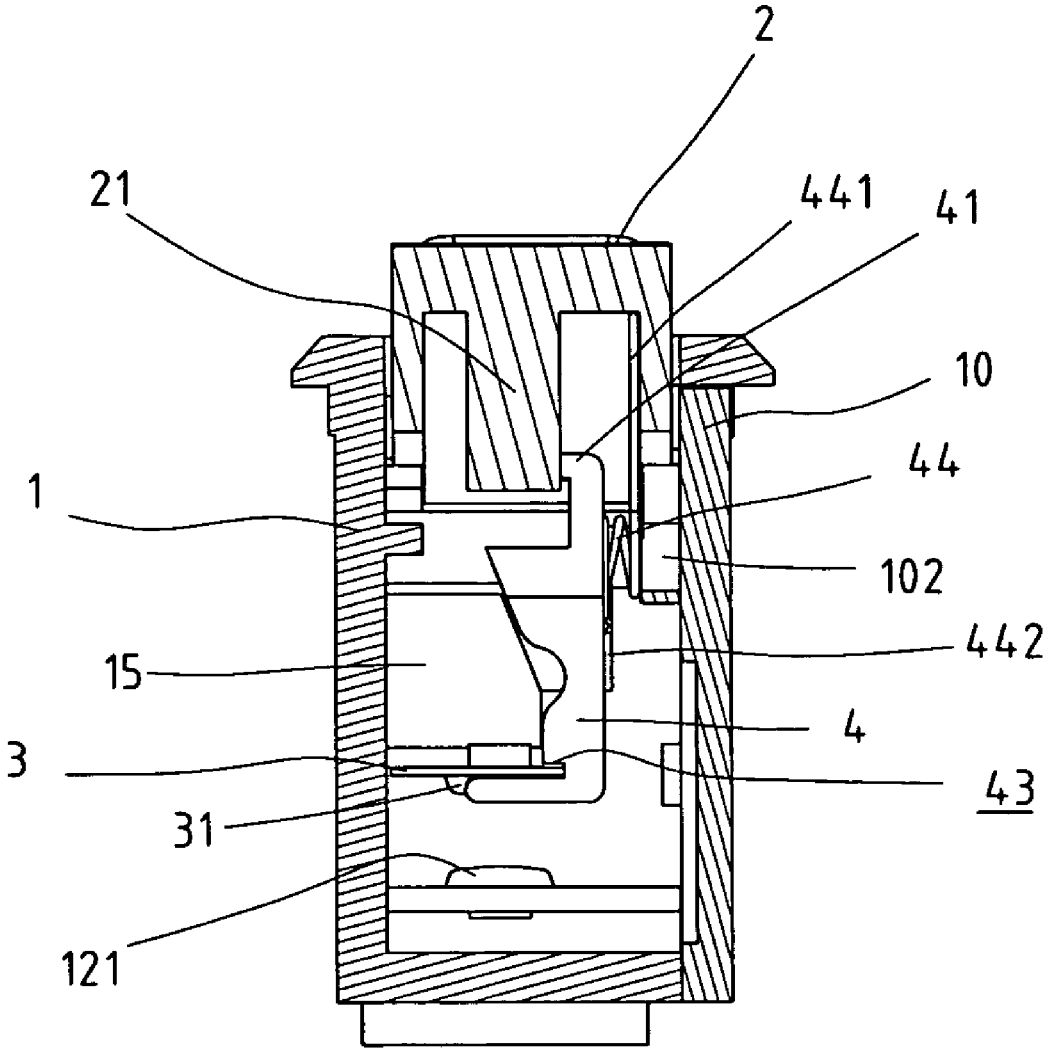
FIG. 8 shows an end cross-sectional view of the circuit breaker of FIG. 7 in an "OFF" position.
Figure 9:
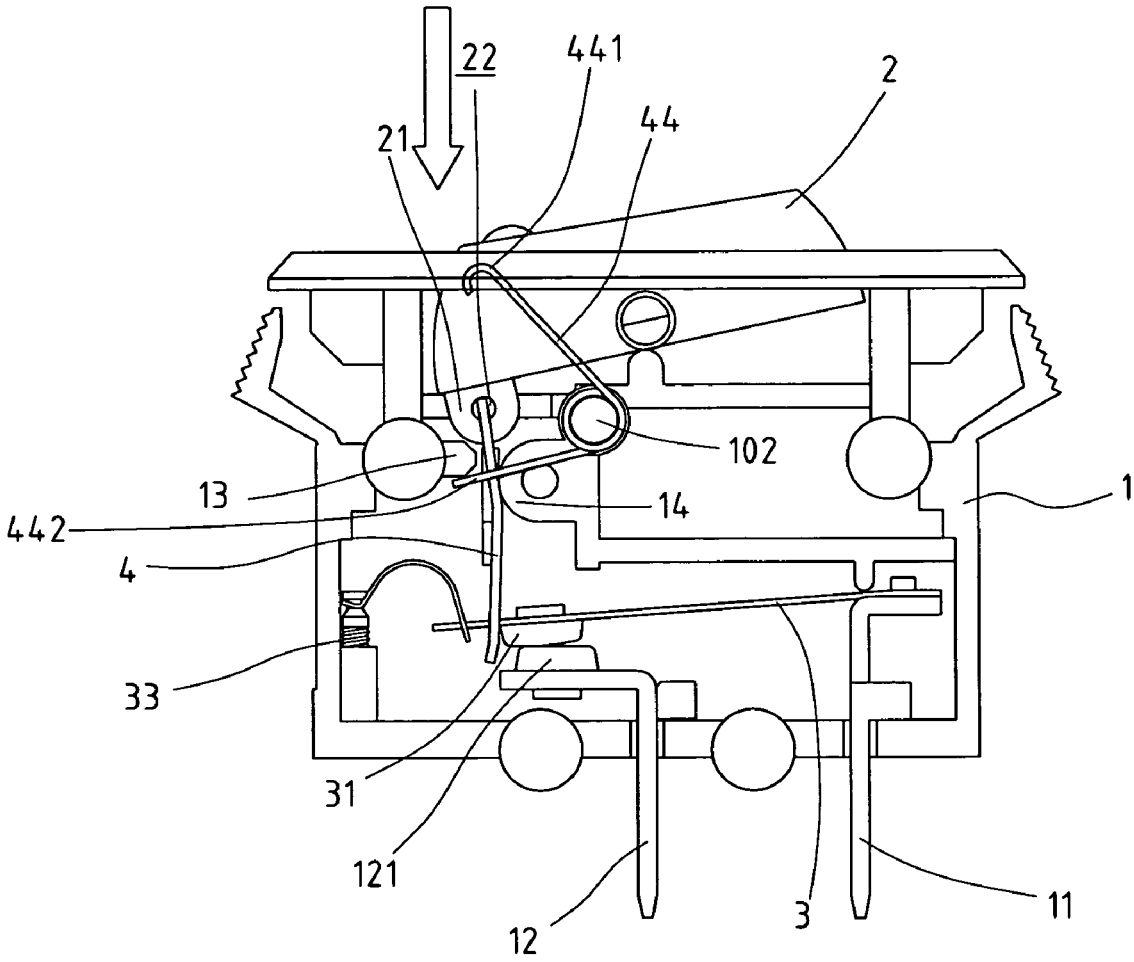
FIG. 9 shows the circuit breaker of FIG. 7 in an "ON" position.
Figure 10:
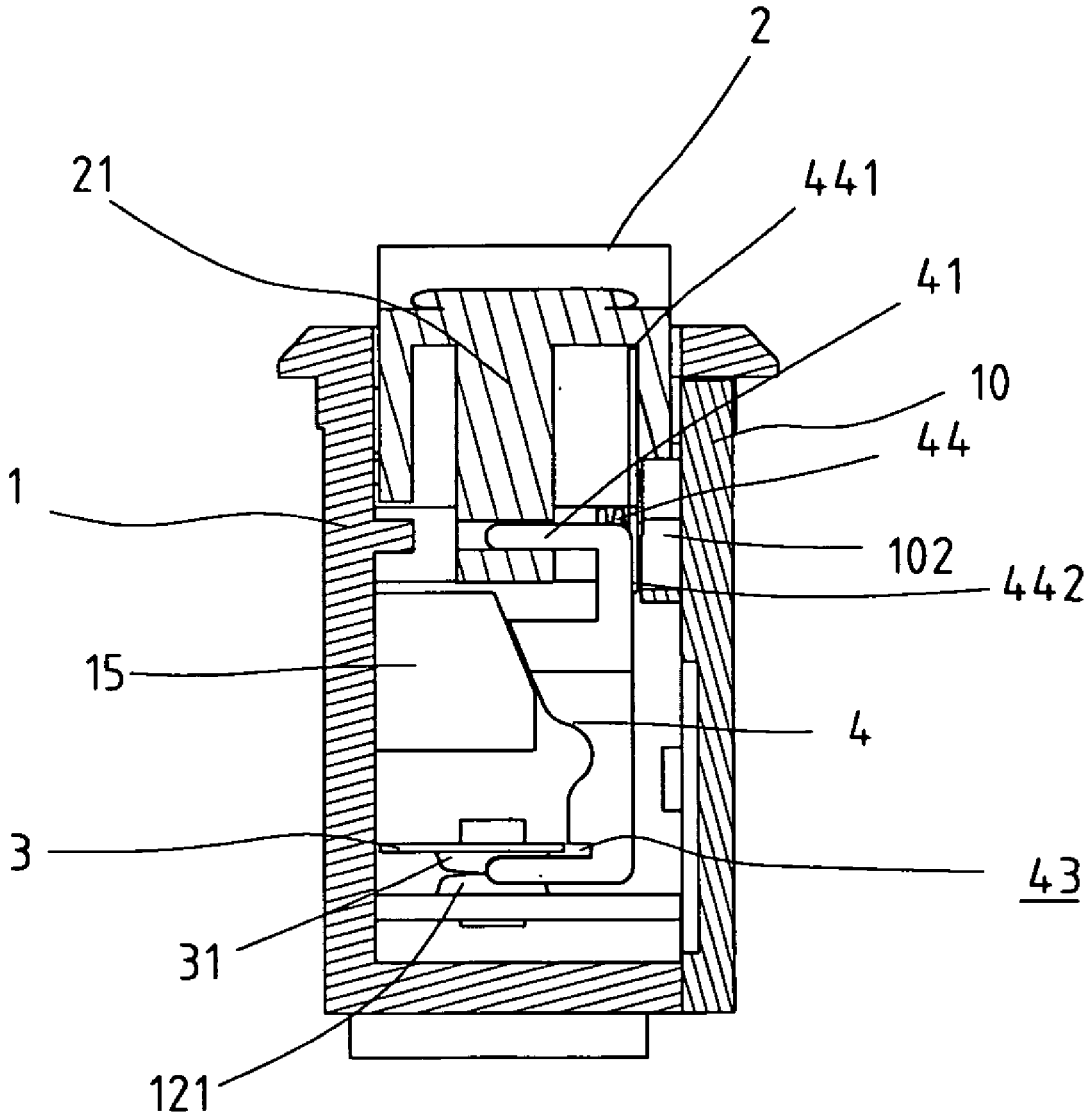
FIG. 10 shows an end cross-sectional view of the circuit breaker of FIG. 7 in an "ON" position.

As shown in FIG. 2, when the left end of the pushbutton 2 is pushed downward, the support member 4 is lowered and the second end of the bimetallic plate 3 is lowered to contact the second contact point 121 so as to form a closed circuit. It is noted that as shown in FIG. 6, when the support member 4 is lowered, the second end of the insertion bar 41 is moved along the inclined surface of the protrusion 101 so that the support member 4 is shifted left in such a way that the upper edge of the slot 43 is removed from the second end of the bimetallic plate 3. On the contrary, when the right end of the pushbutton 2 is pushed as shown in FIG. 1, the second end of the bimetallic plate 3 is separated from the second contact point 121 and the circuit is opened. As shown in FIG. 3, when the circuit is overloaded, since the upper edge of the slot 43 cannot stop the deformation of the bimetallic plate 3, the deformation of the bimetallic plate 3 ensures that the second end of the bimetallic plate 3 is separated from the second contact point 121. The second end of the bimetallic plate 3 is connected to a first end of a curve flexible plate 32 and a second end of the flexible plate 32 is connected to an adjusting bolt 33 that is movably connected to a block in the case 1. By threading the adjusting bolt 33, the curvature of the flexible plate 32 is adjusted so as to properly provide a force to position the bimetallic plate 3 when the bimetallic plate 3 is deformed.

As shown in FIGS. 7–10, another embodiment of the circuit breaker of the present invention includes a similar structure except that there is a protrusion 15 having an inclined surface extending from an inside of the rear wall 2 and the spring 42 in the first embodiment is replaced by a torsion spring 44 which is mounted to a rod 102 on the inside of the front wall of the case 1. A first leg 441 of the torsion spring 44 is engaged with the pushbutton 2 and a second leg 442 of the torsion spring 44 urges the support member 4 toward the inclined surface of the protrusion 15. As can be seen from FIG. 8, the support member 4 has one side pushed by the second leg 442 and an opposite side of the support member 4 is therefore pushed against the inclined surface so that the support member 4 can move up and down along the inclined surface. By this arrangement, the support member 4 is shifted to remove the upper edge of the slot 43 away from the second end of the bimetallic plate 3 when the circuit is in "ON" status.

Figure 11:
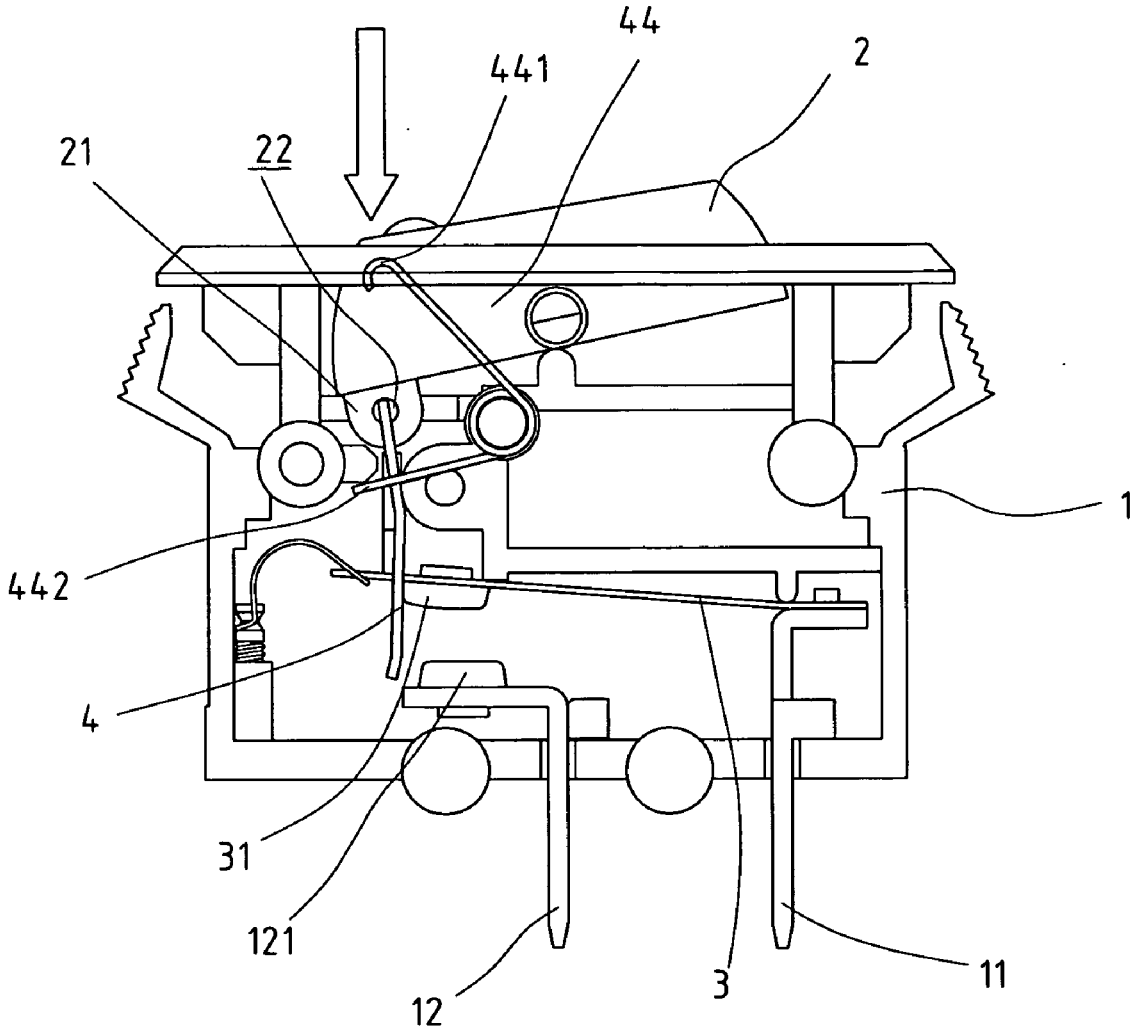
FIG. 11 shows that the bimetallic plate is deformed to cut off the circuit when overloading happens in the circuit breaker of FIG. 7.

As shown in FIG. 11, when the breaker is in "ON" status and the circuit is overloaded, the second end of the bimetallic plate 3 is deformed upward without being stopped by the upper edge of the slot 43, the circuit is cut off. The circuit breaker of the present invention ensures that the bimetallic plate 3 is deformed to cut off the circuit as desired.

While we have shown and described the embodiment in accordance with the present invention, it should be clear to those skilled in the art that further embodiments may be made without departing from the scope of the present invention.

What is claimed is:

1. A circuit breaker comprising:

a case having an open top and a pushbutton pivotally connected between a front wall and a rear wall of the case, a first terminal and a second terminal respectively extending through a bottom of the case, a first end of a bimetallic plate fixedly connected to the first terminal and a first contact point connected to a second end of the bimetallic plate, a second contact point connected to the second terminal and located beneath the first contact point;

a flexible plate having a first end connected to the second end of the bimetallic plate and a second end connected to a block in the case;

a support member having an insertion bar at an upper end and a slot defined by an upper edge and a lower edge in a side of a lower end of the support member, the insertion bar movably connected to the pushbutton, and the second end of the bimetallic plate removably supported by the slot, and a protrusion located in the case and the support member being movable on an inclined surface on the protrusion;

wherein the upper edge of the slot is moved away from the second end of the bimetallic plate in a side way perpendicular to a longitudinal direction of the bimetallic plate when the support member is pushed down along the inclined surface of the protrusion.

2. The circuit breaker as claimed in claim 1, wherein the lower edge of the slot is longer than the upper edge of the slot so that when the support member is pushed down along the inclined surface of the protrusion, the second end of the bimetallic plate can bend upward freely.

3. The circuit breaker as claimed in claim 1, wherein the pushbutton includes an extension that defines a hole and the first end of the insertion bar of the support member is inserted into the hole through a spring which is biased between the extension and the support member to push the support member towards the inclined surface of the protrusion in the side way perpendicular to the longitudinal direction of the bimetallic plate.

4. The circuit breaker as claimed in claim 1, wherein the insertion bar having a first end moveably inserted through a spring and connected to the pushbutton, and a second end of the insertion bar is pushed against and movably in contact with the inclined surface of the protrusion.

5. The circuit breaker as claimed in claim 1, wherein the protrusion extends from an inside of the front wall.

6. The circuit breaker as claimed in claim 1, wherein the protrusion extends from an inside of the rear wall.

7. The circuit breaker as claimed in claim 1, wherein the second end of the flexible plate is connected to an adjusting bolt that is movably connected to the block in the case.

8. The circuit breaker as claimed in claim 1, wherein a torsion spring is mounted to a rod in the case with a first leg of the torsion spring engaged with the pushbutton and a second leg of the torsion spring pushing the support member toward the inclined surface of the protrusion member in the side way perpendicular to the longitudinal direction of the bimetallic plate.

* * * * *